United States Patent [19]

Neef et al.

[11] 3,942,783

[45] Mar. 9, 1976

[54] CLAMPING MECHANISM FOR CLOTH SPREADING MACHINE CATCHER

[75] Inventors: William E. Neef; Easton O. Marshalleck, both of Chicago, Ill.

[73] Assignee: Hart Schaffner & Marx, Chicago, Ill.

[22] Filed: June 26, 1974

[21] Appl. No.: 483,370

[52] U.S. Cl. ..... 270/30; 269/153

[51] Int. Cl. ..... B65h 29/46

[58] Field of Search ..... 270/30, 31; 269/153, 254

[56] References Cited

UNITED STATES PATENTS

| | | | |
|---|---|---|---|
| 1,524,705 | 2/1925 | Gale | 270/30 |
| 1,571,808 | 2/1926 | Schwartzman | 270/30 |
| 2,631,457 | 3/1953 | Gilbert et al. | 270/31 X |

FOREIGN PATENTS OR APPLICATIONS

| | | | |
|---|---|---|---|
| 247,398 | 2/1926 | United Kingdom | 270/30 |

*Primary Examiner*—Lawrence Charles
*Attorney, Agent, or Firm*—Kinzer, Plyer, Dorn & McEachran

[57] ABSTRACT

Remotely operated mechanisms for quickly clamping and unclamping one or both sides of an automatic catcher for a cloth spreading machine to a cloth cutting table. These mechanisms permit the automatic catcher to be clamped to and released from the cutting table by an operator who remains on one side of the table. The operator can also connect and disconnect the automatic catcher relative to the cloth spreading machine while remaining on one side of the cutting table.

9 Claims, 3 Drawing Figures

CLAMPING MECHANISM FOR CLOTH SPREADING MACHINE CATCHER

SUMMARY OF THE INVENTION

This invention is concerned with remotely operated mechanisms for clamping and releasing an automatic catcher for a cloth spreading machine to a cutting table. It is particularly concerned with mechanisms which permit a machine operator standing at one side of a cutting table to quickly fasten and release the automatic catcher.

An object of this invention is to facilitate the rapid attachment and release of an automatic catcher for a cloth spreading machine relative to a cutting table.

Another object is to permit a machine operator to quickly clamp and release an automatic catcher relative to a cloth cutting table without walking from one side of the cutting table to the other.

Another object is a remotely operated latching mechanism which permits an operator to quickly connect the automatic catcher to the cloth spreading machine and release it while remaining on one side of the table.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENTS

Figure 1:
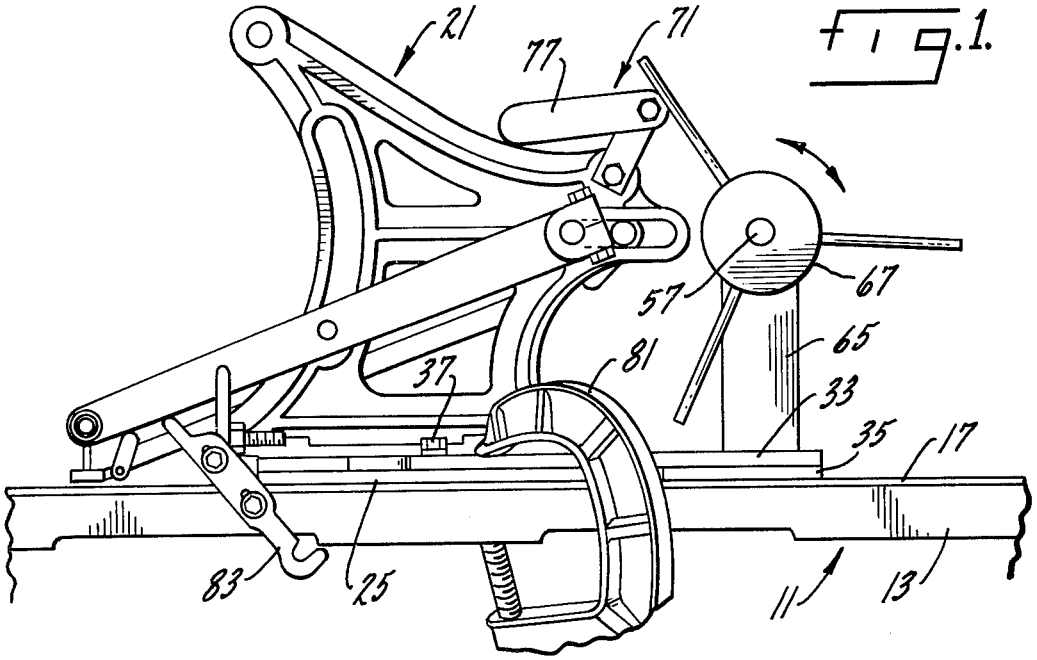
FIG. 1 is a partial side elevational view of one embodiment of an automatic catcher and clamping mechanism mounted on a cloth cutting table.

FIG. 1 shows a cloth cutting table 11 which includes a table top 13 having an upper surface 17 and an under surface 19. An automatic catcher 21 for a cloth spreading machine 23 is located on the table and extends across the width thereof. The catcher is equipped with a base plate 25 which rests on the upper surface 17 of the table top 13.

Figure 2:
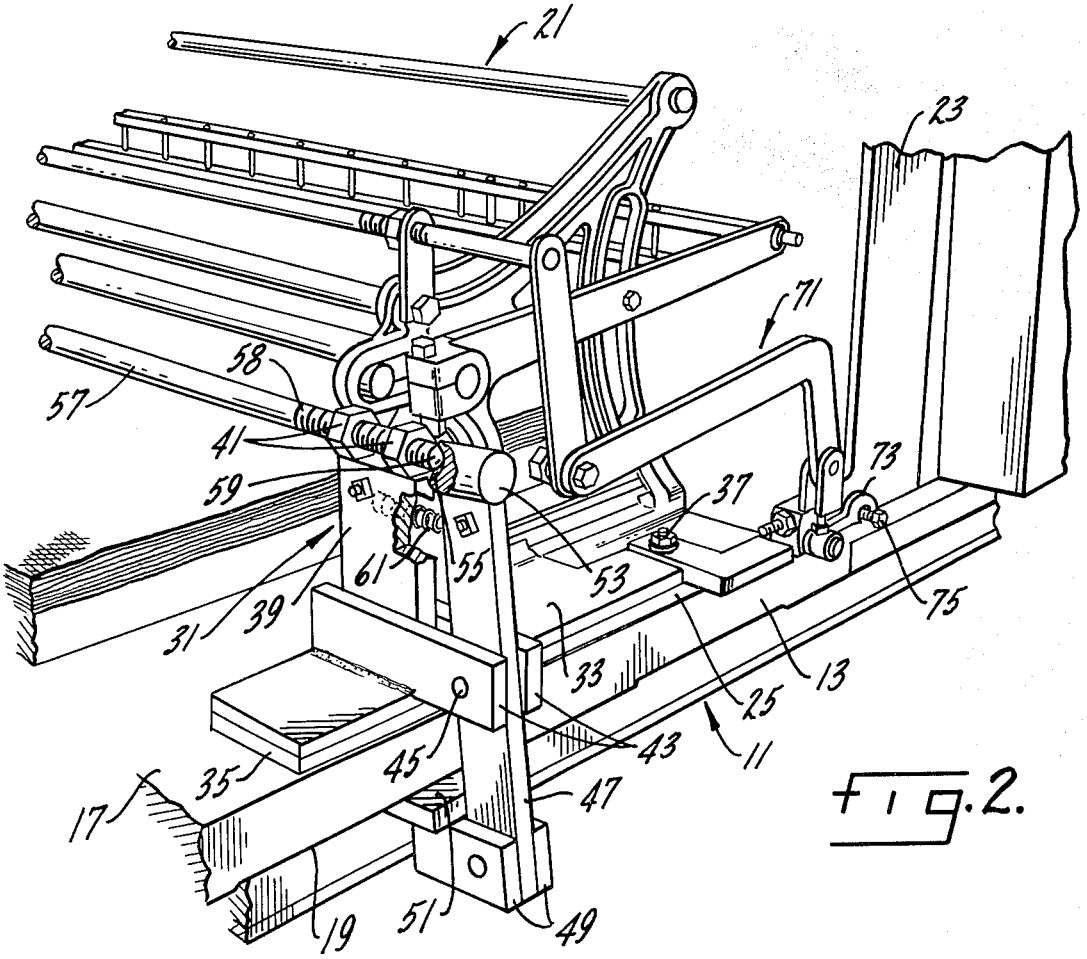
FIG. 2 is a partial perspective view of the opposite side of the automatic catcher and clamping mechanism.

A mechanism 31 for rapidly clamping and releasing one side of the automatic catcher relative to the cutting table is shown most clearly in FIG. 2. This mechanism includes a base plate 33 which rests on and is fastened to the base plate 25 of the automatic catcher and a heel plate 35 which functions as a shim to support the portion of the base plate of the clamping mechanism which extends beyond the base plate of the automatic catcher. The base plates of the automatic catcher and the clamping mechanism are held together by threaded fasteners 37.

An upright transversely extending plate 39 is fastened to the clamping mechanism base plate 33, preferably by welding. A pair of aligned threaded nuts 41 are welded to the top edge of this plate. A pair of rectangular bars 43 are welded to the base plate 33 on opposite sides of the upright plate 39 and extend cantileverly outwardly of the base plate. A horizontally aligned pivot pin 45 extends between the bars 43 and is located outwardly of the base plate 33. A vertically extending arm 47 is rotatively mounted on the pivot pin 45. Inwardly projecting fingers 49 are fastened to the lower end of the arm 47. A jaw 51 is mounted on top of the projecting portions of the fingers 49.

A cylinder 53 is fastened to the top of arm 47, perferably by welding. The inner end of this cylinder is hollowed out to form a socket 55. An operating rod 57 has a threaded portion 58 at one end which extends through the nuts 41 attached to the upright plate 39. This rod has a rounded end 59 which is received in the socket 55 of the cylinder 53. A spring 61 connected to the upright plate 39 and the arm 47 biases the socket 55 against the end 59 of rod 57.

The opposite end of rod 57 is journalled in an upright plate 65 mounted on the base plate 33 of the clamping mechanism 31. An operating handle 67 is attached to this rod. As can be seen in FIG. 1, the operating handle 67 is located on the opposite side of the cutting table from the clamping jaw 51 of the clamping mechanism 31.

A remotely operating latching mechanism 71 is also provided. This mechanism includes a pivotally mounted latch 73 which engages a latch pin 75 mounted on the cloth spreading machine 23. The latch 73 is moved into and out of engagement with the pin 75 by the latching mechanism 71 through a series of links, levers and operating rods controlled by a handle 77 located on the same side of the cutting table as the operating handle 67 of the clamping mechanism. A C-clamp 81 and a cloth spreading machine latch 83 are also provided on the side of the table adjacent the operating handles 67 and 77 for use by the machine operator.

Figure 3:
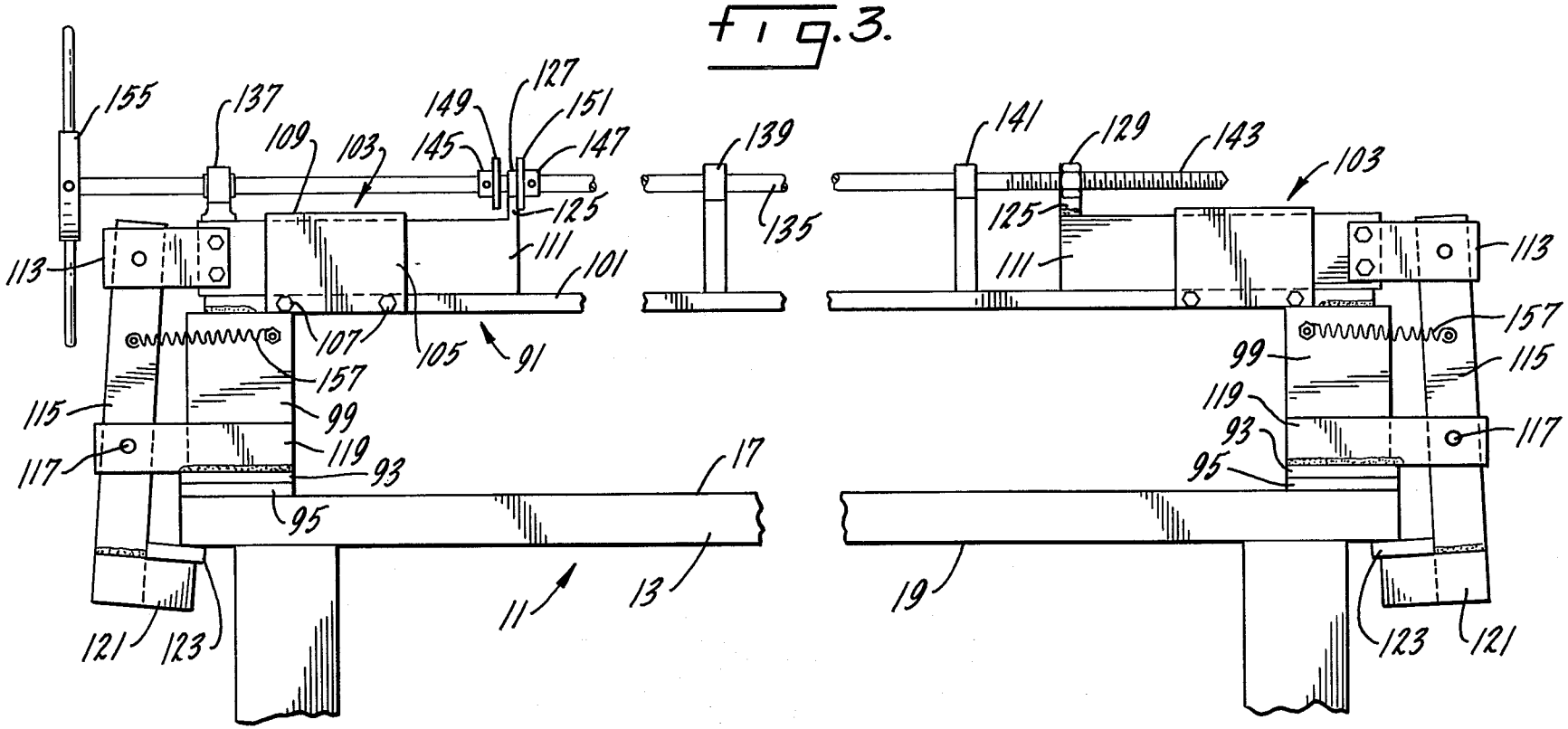
FIG. 3 is a partial end elevational view of a cutting table showing a modified form of clamping mechanism in its clamped position.

A second embodiment of this invention for rapidly clamping and releasing both sides of an automatic catcher relative to a cutting table is shown in FIG. 3 of the drawings. Clamping mechanism 91 is constructed with almost identical parts at each side of the cutting table. At each side of the table, the mechanism 91 includes a base plate 93 which rests on and is fastened to the base plate of an automatic catcher (not shown). It also includes a heel plate 95 which functions as a shim to support the portion of the base plate of the clamping mechanism which extends beyond the base plate of the automatic catcher. The base plates of the automatic catcher and the clamping mechanism 91 are held together by threaded fasteners which are not shown.

An upright transversely extending plate 99 is fastened to the clamping mechanism base plate 93, preferably by welding. A support bar 101 of square cross-section is mounted on the top of the upright plate 99 and is welded thereto. This support bar extends across the width of the cutting table 11 and is fastened to the top of a similar upright plate 99 located at the opposite side of the table. This upright plate is also mounted on a base plate 93 which in turn is mounted on a heel plate 95 resting on the table top 17. A sleeve 103 is mounted on the support bar on each side of the table adjacent to and partially extending over the upright plates 99. Each sleeve is of rectangular cross-section and consists of side plates 105 which are fastened to the support bar 101 by threaded fasteners 107 and a top plate 109 welded to the side plates.

Slide blocks 111 of rectangular cross-section are slideably mounted in each sleeve 103 and extend beyond the ends of the sleeves. The outside ends of the slide blocks are each pivotally connected by a pair of plates 113 to a generally vertically extending arm 115 which is pivotally mounted at 117 to a pair of bars 119 which are welded to the upright plates 99 and extend laterally beyond the sides of the table. Inwardly projecting fingers 121 are fastened to the lower end of each arm 115. A jaw 123 is mounted on top of the inwardly projecting portions of the fingers 121. The inner end of each slide block has an upstanding projection 125 formed thereon. The projection 125 of the slide block shown on the left hand side of FIG. 3 has a bearing 127 mounted thereon. The projection 125 on the slide block 111 on the right side of FIG. 3 has a threaded nut 129 mounted thereon.

An operating rod 135 is journaled in support 137 which is mounted on the slide block 111 shown on the left of FIG. 3 and in supports 139 and 141 which are mounted on the support bar 101. The right hand portion 143 of operating rod 135, as viewed in FIG. 3, is threaded and this threaded portion meshes with the threads of nut 129 mounted on slide block 111. The operating rod also extends through bearing 127 which is mounted on slide bar 111. Sleeves 145 and 147 are affixed to the operating rod 135 and are located on opposite sides of the bearing 127. The sleeves have disks 149 and 151 respectively which are adapted to engage the bearing 127 for the purpose of moving the left hand slide block 111. The spacing between the disks is slightly greater than the width of the bearing 127. A hand wheel 155 is connected to the operating rod 135 on the operator's side of the cutting table. Springs 157 bias the arms 115 to their unclamped positions.

The Use, Operation and Function of this Invention are as follows:

An automatic catcher 21 is provided at each end of layers of cloth laid out by a power operated cloth spreading machine 23. One automatic catcher is generally located at one end of the table and another catcher is located somewhere intermediate the ends of the table in situations where the cutting table is longer than the layout of cloth. Rapid adjustment of this intermediate catcher is the main concern of this invention since the catcher at the end of the table generally is not moved during cloth spreading operations. However, the location of the catcher positioned intermediate the ends of the table must be changed as the length of layout for the cloth varies. This presents problems because the cutting tables may be several hundred feet long. Movement of this intermediate automatic catcher required that the operator first release the C-clamp holding the automatic catcher on one side of the table and then walk around the table and release the C-clamp holding the automatic catcher on the opposite side of the table. At the same time, the operator was removing the C-clamps, it was necessary for him to latch the automatic catcher to the cloth spreading machine since the power operated cloth spreading machine was used to move the catcher.

This invention enables the cloth spreading machine operator to rapidly move the automatic catcher to a selected position, disconnect it from the cloth spreading machine, and clamp it to the cutting table while remaining on one side of the cutting table. This sequence of operations can be accomplished in the following manner:

Assume that the automatic catcher 21 is clamped to the table 11 in the manner shown in FIG. 1 using a C-clamp 81 on the operator's side and the clamping mechanism 31 on the opposite side of the table. The operator removes the C-clamp 81 from the table in the normal manner. He then rotates the handle 67 thereby turning the rod 57 which, because of its threaded engagement with the nuts 41, will move away from the cup 55 at the upper end of the pivotally mounted arm 47. The spring 61 pulls the jaw 51 attached to the lower end of the arm away from contact with the under surface 19 of the table top 13.

With the automatic catcher 21 thereby unclamped from the table, the operator connects the automatic catcher latch 83 on his side of the table to the cloth spreading machine 23 and rotates handle 77 moving the latch 73 on the other side of the automatic catcher into engagement with latch pin 75 on the cloth spreading machine 23. Movement of the cloth spreading machine will then pull the catcher to a new location. At the new location, the operator releases latch 83 from the cloth spreading machine. He then rotates handle 77 thereby releasing latch 73 from latch pin 75 on the opposite side of the cloth spreading machine. The operator can then attach the automatic catcher to the table through the use of C-clamp 81 and by rotating operating handle 67 which moves rod 57 into engagement with the cup 55 on the upper end of arm 47. This in turn moves the clamping jaw 51 of the clamping mechanism into clamping engagement with the under surface 19 of the table top 13.

The modified clamping mechanism 91 is shown in FIG. 3 of the drawings is used with an automatic catcher in the same manner as heretofore described for the clamping mechanism of FIGS. 1 and 2. However, this clamping mechanism simultaneously clamps and released both sides of the cutting table and therefore eliminates the need for the C-clamp 81 on the operator's side of the table. The clamping mechanism 91 operates in the following manner:

Assume that the automatic catcher is clamped to the cutting table with the jaws 123 of the clamping mechanism 91 engaging the undersurfaces 19 on each side of the table in the manner shown in FIG. 3. To unclamp the automatic catcher, the operator rotates the hand wheel 155 thus rotating the operating rod 135. If the threaded portion 143 of the rod has a right hand thread, the operator will turn the hand wheel 155 in a clockwise direction. Rotation of the rod causes the threaded end 143 of the rod to move through the nut 129 thereby moving the rod 135 to the right as viewed in FIG. 3 until the disk 149, which was initially located to the left of the bearing 127, engages the bearing 127. Continued rotation of the rod 135 in a clockwise direction after engagement of the disk 149 with the bearing 127 will move the left hand slide block 111 to the right, thus unclamping the left hand jaw 123. When the slide block 111 is moved its maximum distance to the right, it will stop and continued rotation of the rod 135 will cause the nut 129 to move along the rod to the left as viewed in FIG. 3, thereby carrying its slide block 111 towards the center of the table and unclamping the right hand jaw 123. During unclamping operations, the springs 157 will aid in unclamping movement of the jaws.

When the automatic catcher is moved to a new position, rotation of the operating wheel 155 in the opposite direction will bring about clamping movement of the arms 115. Upon opposite rotation, the disk 151 will engage the bearing 127 and move the slide block 111 on the left hand side of the table until its jaw 123 is clamped. Continued rotation of the rod 135 in the same direction will then cause the nut 129 and its attached slide block 111 to move towards the outside of the table thus clamping the right hand jaw 123 to the table.

We claim:

1. A remotely operated mechanism for quickly clamping and unclamping an automatic catcher for a cloth spreading machine relative to a cloth cutting table, said clamping mechanism including:

means to attach said clamping mechanism to an automatic catcher with said attaching means resting on and engaging top of said cutting table, a movable jaw mounted to be moved into engagement with the underside of said cutting table on one side thereof, to cooperate with said attaching means in a clamping action, and means operable from the opposite side of said cutting table for moving said movable jaw into and out of clamping engagement with said table, said movable jaw being attached to the lower end of an arm which is pivotally mounted for rotation about a horizontal axis.

2. The mechanism of claim 1 in which said movable jaw operating means includes a threaded rod which engages said arm and upon rotation moves relative to said arm to pivot said arm thereby to move said jaw into engagement with the underside of said table.

3. The mechanism of claim 2 in which said threaded rod engages a socket formed as part of said arm and a spring means biases said socket against the end of said rod.

4. The mechanism of claim 1 in which a latching hook is pivotally mounted on said automatic catcher on the same side of said cutting table as is said movable jaw, said hook being pivotally movable into and out of latching engagement with said cloth spreading machine, and means are located on the opposite side of said table for moving said hook into and out of said latching position.

5. A mechanism for quickly clamping and unclamping an automatic catcher for a cloth spreading machine relative to both sides of a cloth cutting table, said mechansim including:

means to attach said clamping mechanism to an automatic catcher with said attachment means resting on and engaging the top of said cutting table, a movable jaw located on each side of said table with each jaw mounted to be moved into engagement with the underside of said cutting table to cooperate with said attaching means in a clamping action, and means operable from one side of said table for moving said jaws into and out of clamping engagement with said table.

6. The mechanism of claim 5 in which each movable jaw is attached to the lower end of an arm which is pivotally mounted for rotation about a horizontal axis.

7. The mechanism of claim 6 in which the upper end of each arm is pivotally connected to a slide block and said means operable from one side of said table for moving said jaws into and out of clamping engagement with said table includes means for moving said slide blocks towards and away from each other.

8. The mechanism of claim 7 in which said means for moving said slide blocks includes an operating rod mounted to rotate and to move longitudinally relative to said slide blocks, said operating rod having a threaded portion which meshes with a drive nut affixed to one of said slide blocks and a connection to said other slide block which permits said rod to rotate relative to said slide block but engages and moves said slide block upon longitudinal movement of said rod.

9. The mechanism of claim 8 in which said operating rod connection includes a bearing affixed to said slide block and receiving said operating rod and a pair of disks affixed to said operating rod on opposite sides of said bearing with said disks spaced apart a greater distance than the width of said bearing and adapted to engage said bearing to limit movement of said rod longitudinally relative to said bearing in opposite directions.

* * * * *